US005109179A

United States Patent [19]

Faillon et al.

[11] Patent Number: 5,109,179

[45] Date of Patent: Apr. 28, 1992

[54] ELECTRON GUN PROVIDED WITH A DEVICE PRODUCING A MAGNETIC FIELD IN THE NEIGHBORHOOD OF A CATHODE

[75] Inventors: Georges Faillon, Meudon; Christophe Bastien, Asniers; Christine Farvet, La Celle Saint Cloud, all of France

[73] Assignee: Thomson Tubes Electroniques, Billancourt, France

[21] Appl. No.: 464,458

[22] Filed: Jan. 12, 1990

[30] Foreign Application Priority Data

Jan. 17, 1989 [FR] France ..... 89 00484

[51] Int. Cl.[5] ..... H01J 1/50; H01J 3/02; H01J 3/12

[52] U.S. Cl. ..... 313/153; 313/155; 313/443

[58] Field of Search ..... 313/153, 155, 443

[56] References Cited

U.S. PATENT DOCUMENTS

| | | | |
|---|---|---|---|
| 2,149,101 | 2/1939 | Ploke | 313/443 |
| 2,347,990 | 5/1944 | Coeterier | 313/443 |
| 2,785,330 | 3/1957 | Fogelberg et al. | 313/443 |
| 2,934,666 | 4/1960 | Shrader | 313/443 |
| 3,052,808 | 9/1962 | Klein . | |
| 3,092,745 | 6/1963 | Veith et al. | 313/153 X |
| 3,141,988 | 7/1964 | Murphy | 313/443 |
| 3,225,248 | 12/1965 | Scheffels | 313/443 X |
| 3,522,469 | 8/1970 | Miram | 315/3.5 |
| 3,832,596 | 8/1974 | Nelson | 315/3.5 |

FOREIGN PATENT DOCUMENTS

| | | |
|---|---|---|
| 1067532 | 10/1959 | Fed. Rep. of Germany . |
| 1144405 | 2/1963 | Fed. Rep. of Germany . |
| 1244967 | 7/1967 | Fed. Rep. of Germany . |
| 73213 | 9/1960 | France . |
| 1320596 | 1/1963 | France . |
| 2107111 | 4/1983 | United Kingdom . |

*Primary Examiner*—Palmer C. DeMeo
*Attorney, Agent, or Firm*—Roland Plottel

[57] ABSTRACT

This disclosure concerns electron guns comprising several electrodes, including a cathode. The gun has a device producing a magnetic field, adjustable if necessary, in the vicinity of the cathode. This device works together with one of the electrodes other than the cathode. It cooperates notably with the anode or the wehnelt. This device is either a solenoid or one or more permanent magnets. This device is placed either inside or outside the gun. It can be applied to high-power, "O" type electron tubes.

8 Claims, 5 Drawing Sheets

ELECTRON GUN PROVIDED WITH A DEVICE PRODUCING A MAGNETIC FIELD IN THE NEIGHBORHOOD OF A CATHODE

BACKGROUND OF THE INVENTION

1. Field of the Invention

The present invention pertains to electron guns producing a cylindrical electron beam. It pertains more particularly to guns working under high voltage. These guns are used notably in longitudinal interaction electron tubes. These tubes are called "O" type tubes. In this type of tube, the electron beam is focused by a magnetic field colinear with the path of the electrons. Klystrons, travelling wave tubes, are "O" type tubes. It is possible to use these guns in other devices under vacuum, such as particle accelerators.

2. Description of the Prior Art

An electron gun producing a long and narrow electron beam is generally built around an axis of revolution. It has a cathode, generally made of a thermo-emissive material, heated and carried to a generally negative potential. It is surrounded by a focusing electrode known as a wehnelt cylinder, carried to the same potential as the cathode. The cathode emits an electron beam towards an anode. The wehnelt cylinder causes the beam of electrons coming from the cathode to converge. These two electrodes are surrounded by the anode. The anode and the wehnelt cylinder are opened at their center to let through the electron beam coming from the cathode. Grids may be inserted between the cathode and the wehnelt cylinder. Ceramic elements, with a cylindrical shape for example, act as a support for the electrodes and insulate them electrically from one another. The electron beam, emitted by the cathode and focused by the wehnelt cylinder and the anode, then penetrates a tunnel-shaped part which is the body of the electron tube. This body is generally grounded. The anode may be either carried to an intermediate potential between that of the cathode and that of the body of the tube, or carried to the same potential as the body of the tube. Within the body of the tube, the beam is focused by means of a solenoid, a permanent magnet or a sequence of alternating contiguous magnets. The body of the tube ends in an electron collector.

In order to obtain a homogeneous electron beam, having a desired diameter and little undulation, it is necessary to adjust the flux of the magnetic field that applies all along the electron beam, in the gun and in the body of the tube. The undulation of the electron beam is due to the effects of mutual repulsion of the electrons. At the cathode, the induction must be weak so as not to disturb the emission of electrons. It is increased as and when the distance from the cathode is increased in order to make the electron beam converge in the gun. Finally, the induction is given a constant value outside the gun, that is, in the body of the tube.

To prevent a excessively intense magnetic field from prevailing in the immediate vicinity of the cathode, a pole piece is generally placed between the gun and the body of the tube. This piece forms a screen with respect to the strong field present in the body of the tube. To obtain a beam having a desired with little undulation at the outlet of the gun, an appropriate compromise has to be made between the induction on the cathode, the induction in the body of the tube, the radius of the beam and its undulation. These configurations of the magnetic field are of vital importance and certain solutions have been provided for the problems related thereto:

The pole piece can be given a particular geometry. It is generally made of mild steel. From one piece to another, it may be variably open, variably thick and variably conical. However, the main action of the pole piece on the electron beam is only at the outlet of the gun. It has little effect at the cathode.

The gun may also be shielded by placing a cylindrical shield, made of mild steel, outside the gun. This shield is placed around ceramic elements, at the cathode but outside the gun. It is also possible to add a small solenoid inside the shield. This enables the adjustments during tests to be made more precise. In the case of a gun used in high-power and/or low frequency tubes, the electrodes are taken to high frequencies and there is a big space between them, in order to prevent jump sparks. Consequently, the gun has a large diameter and the shield will therefore also have a large diameter. It will be relatively distant from the cathode and its influence on the magnetic field at the cathode will therefore be weak, even if a small complementary solenoid has been added.

The present invention seeks to overcome these drawbacks and proposes an electron gun provided with a device producing a magnetic field in the vicinity of the cathode.

SUMMARY OF THE INVENTION

According to the invention, there is proposed an electron gun comprising several electrodes, including a cathode, and a device for the production of a magnetic field, said device working together with an electrode other than the cathode and being close to the cathode to set up a controlled magnetic field in the immediate vicinity of the cathode.

In certain embodiments, an electrode will act as a support to a solenoid, the electrical supply of the solenoid will be provided from a generator, the potential of which is referenced with respect to the potential of this electrode or to a neighboring potential. For example, the electrode is the wehnelt cylinder or anode; since these electrodes surround the front face of the cathode, they enable the creation of a well controlled magnetic field in the immediate vicinity of the front face of the cathode.

In other embodiments, an electrode other than the cathode may act as a support to permanent magnets distributed in a ring around the cathode.

According to another characteristic of the invention, it is provided that the electrode, other than the cathode, which works together with the device for the production of a magnetic field, may be made of a magnetic material: the electrode itself then enables a magnetic flux (generated by magnets or by a solenoid) to be guided around the front face of the cathode; since the electrode is close to the cathode, it is thus possible to achieve very efficient control over and, if necessary, to adjust the magnetic field in the immediate vicinity of the cathode. The magnets or the solenoid may then be carried by the electrode or may simply be in contact with an end of this electrode, even if this end is at a distance from the cathode: for example, the electrode, wehnelt cylinder or anode is made of a magnetic material and a solenoid is placed in magnetic contact with the electrode outside the gun, at the place where the electrode is supported by the external wall of the gun.

BRIEF DESCRIPTION OF THE DRAWINGS

Other features and advantages of the invention will appear from the following description, illustrated by the appended figures, of which.

In these figures, the same references represent the same elements.

DETAILED DESCRIPTION OF THE INVENTION

Figure 1:
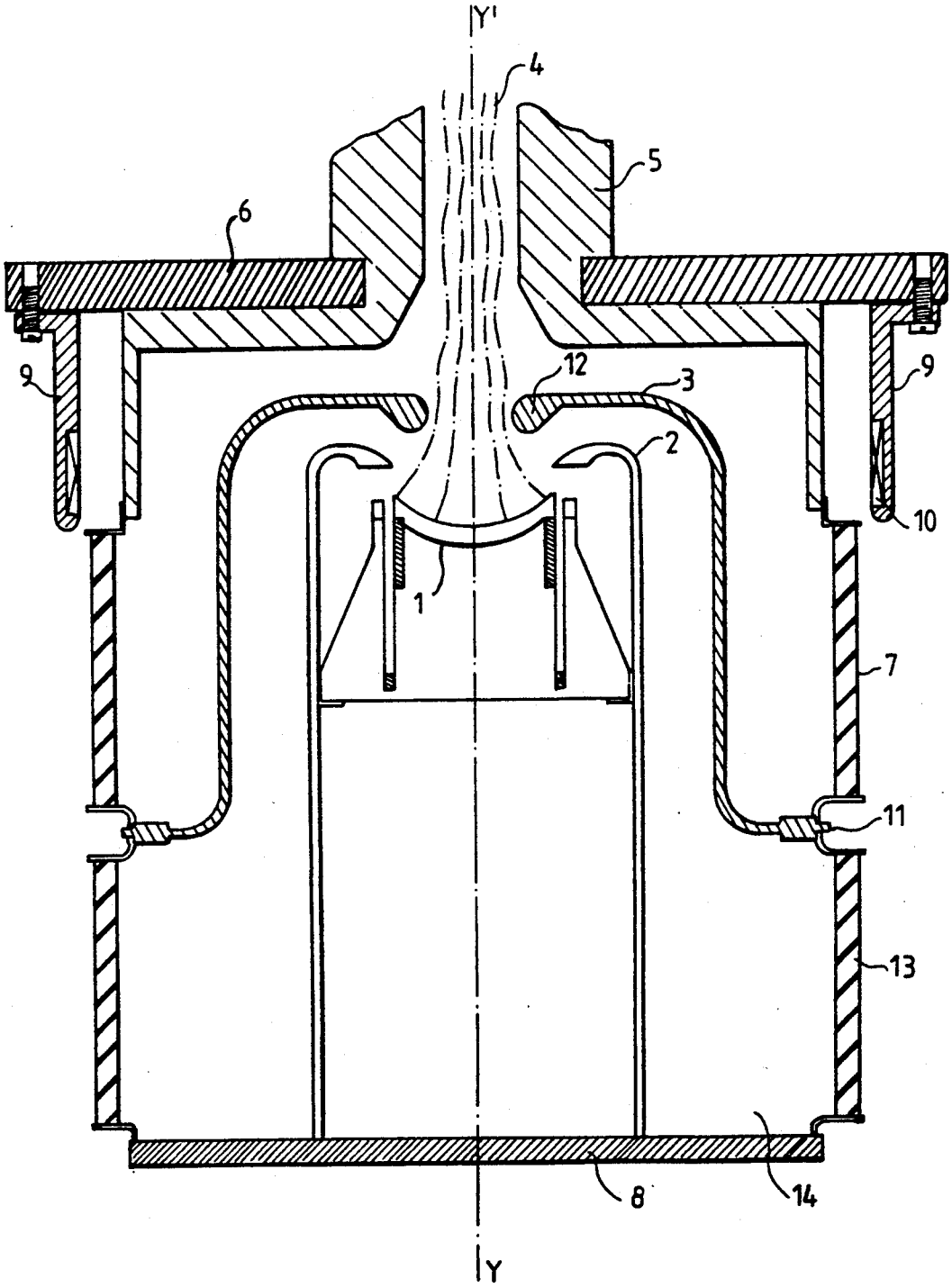
FIG. 1 shows a sectional view of an "O" type electron gun, producing a cylindrical electron beam integrated into a prior art tube.

The gun shown in FIG. 1 is built around an axis YY' of revolution. The gun is integrated into an "0" type tube, only the body 5 of which is shown. The gun includes a cathode 1, made of a thermo-emissive material. It has the shape of a shallow cup and is heated to about 1100° C. by a filament that is not shown. This cathode is taken to a high potential $-V_O$ of about 100 kV. It gives rise to an electron beam 4 that is convergent through the action of a focusing electrode or wehnelt cylinder 2 which surrounds the cathode 1. The electron beam 4 is substantially shaped like a cylinder, and is accelerated towards the body 5 of the tube. The wehnelt cylinder is generally made of molybdenum, stainless steel or copper. It is carried to the same potential $-V_O$ as the cathode 1. An anode 3 surrounds the wehnelt cylinder 2. This anode 3 is carried to a potential $-V_A$. In general, it is wholly or partly made of molybdenum or copper. Grids may be interposed between the cathode 1 and the wehnelt cylinder 2. FIG. 1 does not show any grid. The gun essentially includes all the electrodes located between the cathode 1 and the anode 3. The body of the tube, which is generally made of copper, is grounded.

The effects of mutual repulsion of the electrons act against the maintaining of a long and narrow electron beam, and a focusing device is necessary all along the gun and especially at the body of the tube. This focusing device is generally magnetic. Around the body of the tube, it may be constituted by permanent magnets, a solenoid or alternating, contiguous magnets. No focusing device is shown.

The anode 3 is fixedly joined by one of its ends 11 to a first spacer 7 and a second spacer 13 which are insulating, cylindrically shaped and surround the gun. The spacer 7 keeps the anode 3 in position and electrically insulates it from the body 5 of the tube. The cathode 1 and the wehnelt cylinder 2 are fixed to a circular insulating wall 8 which closes the bottom of the gun. The insulating second spacer 13 takes support, by one side, on the periphery of the insulating wall 8 and, by the other side, on the end 11 of the anode 3. It contributes to insulating the cathode 1 and the wehnelt cylinder 2 from the anode 3. The other end 12 of the anode 3, placed in the vicinity of the cathode 1, makes the electron beam converge. This end 12 of the anode 3 may be made of a different material from the rest of the anode. The spacers 7 and 13 and the wall 8 are generally made of ceramic. They contribute, with the body of the tube, to defining an imperviously sealed chamber 14 surrounding the electrodes of the gun. This chamber 14 is under vacuum.

The gun is partially submerged in a magnetic field. The induction on the cathode 1 should be weak but it has to increase in the interval located between the cathode 1 and the body 5 of the tube.

In the case of a gun working at high voltage, the diameter of the spacers is big so as to leave a suitable insulating space between the different electrodes. This prevents the risks of jump sparks between the electrodes and the body of the tube, or between electrodes carried to different potentials.

A pole piece 6, generally made of mild steel, separates the gun from the body 5 of the tube. The geometry of this pole piece 6 enables the focusing of the electron beam 4 to be made to vary. From one piece to another, it may be variably open, variably thick and variably conical. The pole piece 6 focuses the electron beam especially between the anode 3 and the inlet to the body of the tube. This pole piece does not enable the magnetic field to be adjusted as required inside the gun. It acts above all as a screen against the fairly intense magnetic field prevailing in the body of the tube, so that this field remains weak enough in the immediate vicinity of the cathode.

Another prior art structure has a cylindrical, magnetic shield 9, made of mild steel for example, around the gun, external to the spacers 7, 13. This shield 9 is placed between the outlet of the cathode 1 and the pole piece 6. The shield 9 may be fixed to the pole piece 6. It is even possible to add a solenoid 10 to this shield 9, so as to enable more precise adjustments of the magnetic field during the tests.

In guns working at high voltage, the cylindrical shield 9 has a big diameter because of the insulation spaces along electrodes. Its effect on the focusing of the electron beam 4 is very small even if the solenoid 10 is added.

Figure 2:
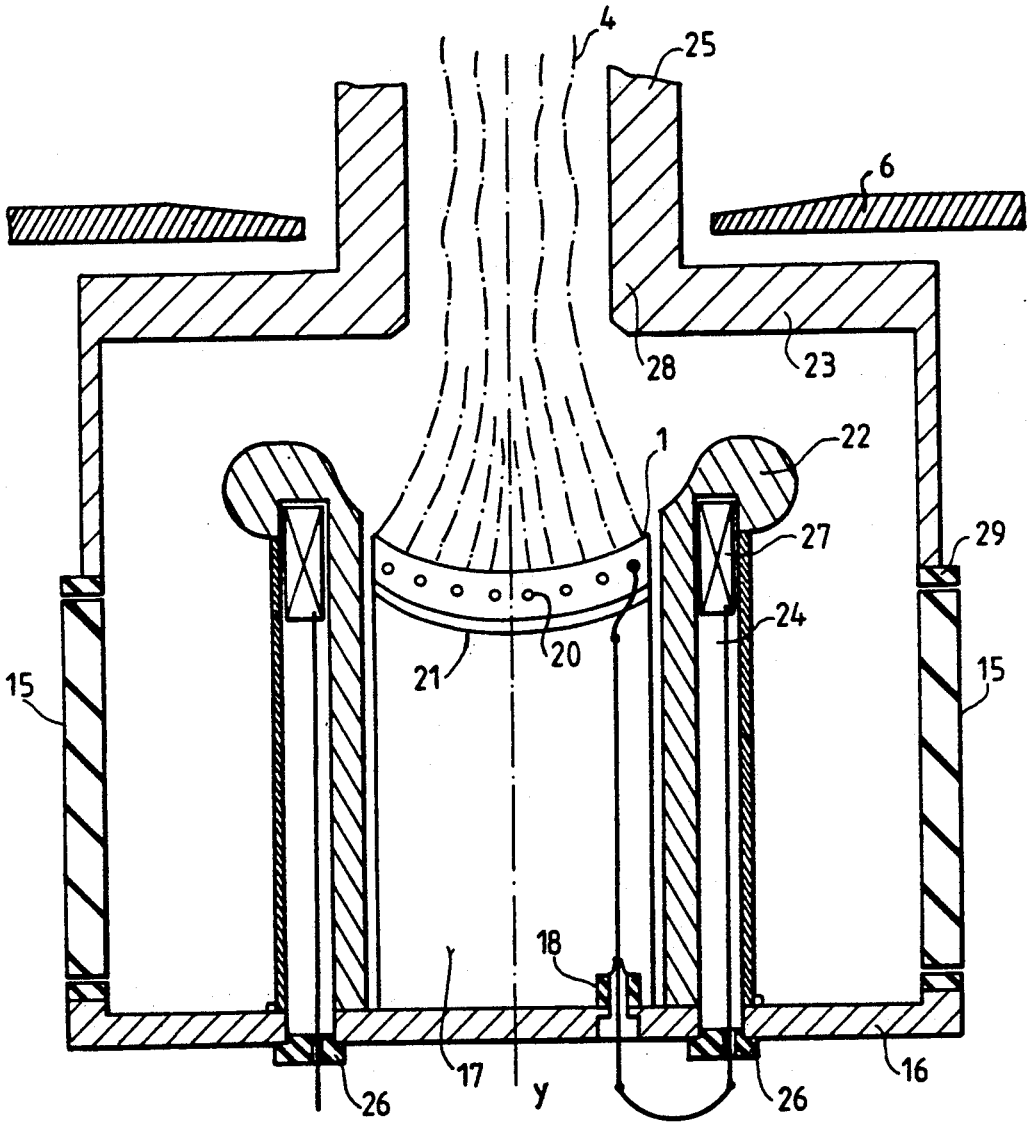
FIG. 2 shows a sectional view of an electron gun with a non-insulated anode and a solenoid producing an adjustable magnetic field integrated into the wehnelt cylinder.

FIG. 2 shows a sectional view of an electron gun with an axis YY' comparable to that of FIG. 1. But it is provided with a device producing a magnetic field in the vicinity of the cathode. In this example, the magnetic field is adjustable since it is produced by a solenoid and since it is possible to take action on the current going through this solenoid.

The gun is integrated into an "0" type tube, of which only a part of the body 25 has been shown. Moreover, the gun has an anode 23 carried to the same potential as the body 25. It is fixedly joined, by one of its ends 28, to the body 25 of the tube. Its other end 29 is fixedly joined to a spacer 15, comparable to the spacer 13 of FIG. 1. This spacer 15 rests on an insulating wall 16 which closes the gun. The body of the tube 25, the anode 23 as well as the spacer 15 and the wall 16 contribute to defining a vacuum-tight chamber 17.

The cathode 1 is shaped like a shallow cup. It is provided with a heating filament 20. The cathode 1, heated to a high temperature of the order of 1100° C., produces an electron beam 4. A thermal screen 21 is placed in the vicinity of the filament 20 in order to thermally stabilize the interior of the chamber 17. The cathode 1 is surrounded by a wehnelt cylinder 22. The device producing the adjustable magnetic field is integrated into the wehnelt cylinder 22. The wehnelt cylinder 22 has a cavity 24, within which a solenoid 27 has been placed. This solenoid 27 is located in the vicinity of the cathode 1 and it acts efficiently on the electron beam 4. The solenoid 27 has an annular or similar shape. It is mounted coaxially with the cathode 1. It is observed that the wehnelt cylinder has been thickened so as to enable the solenoid 27 to be housed. In high-voltage guns, since the parts of the gun are generally thick, there is no obstacle to the introduction of the solenoid 27 The cavity 24 does not communicate with the interior of the chamber 17. The cavity 24 opens out to the exterior of the chamber 17 in going through the wall 16. The cavity 24 can be shut by an impervious cap 26 placed on the wall 16 so that the interior of the cavity 24 is not in contact with the environment external to the chamber 17. The external environment is either air or oil or, again, sulphur fluoride $SF_6$. These materials play an insulator role.

It is also possible for the solenoid 27 to be in contact with the environment external to the chamber 17. In this case, the cap 26 shutting the cavity 24 is no longer needed.

The wire used to make the solenoid 27 may be made of pure tungsten or tungsten alloyed with rhenium for example. The wire used to make this solenoid is insulated by suitably shaped ceramic parts. The solenoid 27 is taken, as a whole, to the potential of the wehnelt cylinder, hence to the potential $-V_O$ of the cathode 1. The solenoid may be series-mounted with the heating filament 20 as shown in FIG. 2. At least one imperviously sealed passage 18, placed in the wall 16, provides for imperviousness between the exterior and the interior of the chamber 17 at the level of the wire connecting the solenoid to the heating filament The wehnelt cylinder will be made of a magnetic, metallic material such as mild steel or soft iron. However, it may also be a non-magnetic material, the field being then directly that of the solenoid.

Figure 3:
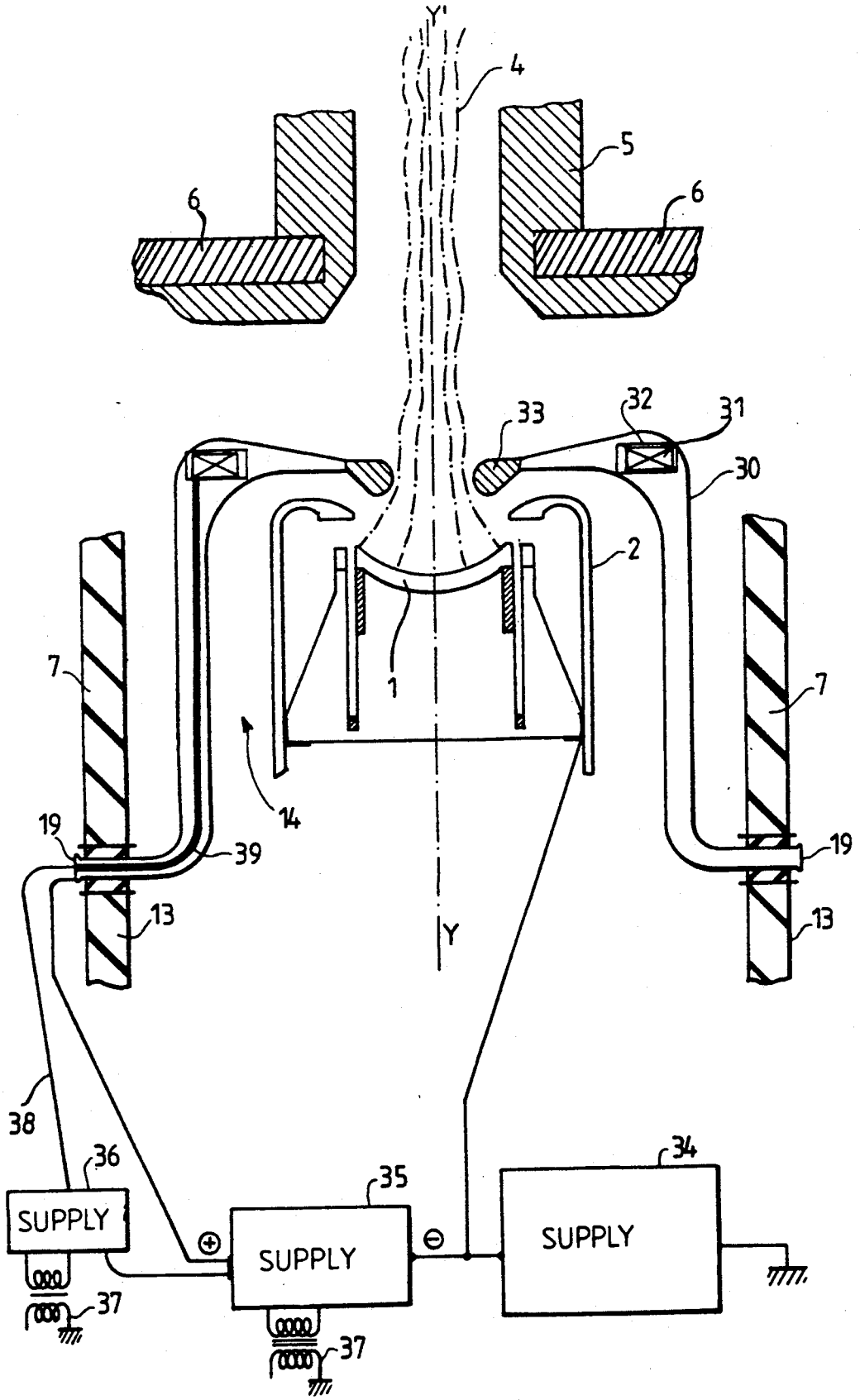
FIG. 3 shows a sectional view of an electron gun including an anode fitted out with a solenoid designed to adjust the magnetic field in the vicinity of the cathode.

FIG. 3 shows a sectional view of an electron gun, comparable to that of FIG. 1. It is provided with another variant of the device producing the magnetic field adjustable in the vicinity of the cathode 1. This device is integrated into the anode 30 and not the wehnelt cylinder In this figure, the anode 30 that surrounds the wehnelt cylinder 2 has a cavity 32 within which a solenoid 31 is placed. In this case, the anode 30 is isolated from the body 5 of the tube as shown in FIG. 1. It is wholly or partially made of a magnetic, metallic material such as soft iron or mild steel. A first end 19 of the anode 30 is fixedly joined to the spacers 7 and 13. The other end 33 of the anode 30, close to the cathode 1, is made of a material different from the rest of the anode. This material may be molybdenum for example. The magnetic, metallic material will be variably long and variably thick. It is also appropriate that this material should not heat up excessively and that it should not lose permeability. Preferably, the material used will be manufactured under vacuum so as to prevent any untimely degassing.

The solenoid 31 could then be placed close to the electron beam 4, at a variable distance from it, depending on the effect desired on the magnetic flux lines existing in the gun. This solenoid 32 will be supplied by means of a supply 36 referenced with respect to the potential of the anode 30. The current may be controlled during the tests by means of optic fibers, for example. The reference 34 represents the supply of the cathode 1 giving the potential $-V_O$. The reference 35 represents the supply of the anode 30 giving the potential $-V_A$. The supply 35 of the anode and the supply 36 of the solenoid will be each provided with an insulation transformer 37. The solenoid 31 is connected to its supply 36 by means of a conductor 38 inserted in a conduit 39 which goes into the anode 30 and opens out at its end 19 outside the chamber 14 demarcated by the spacers 7, 13.

Figure 4:
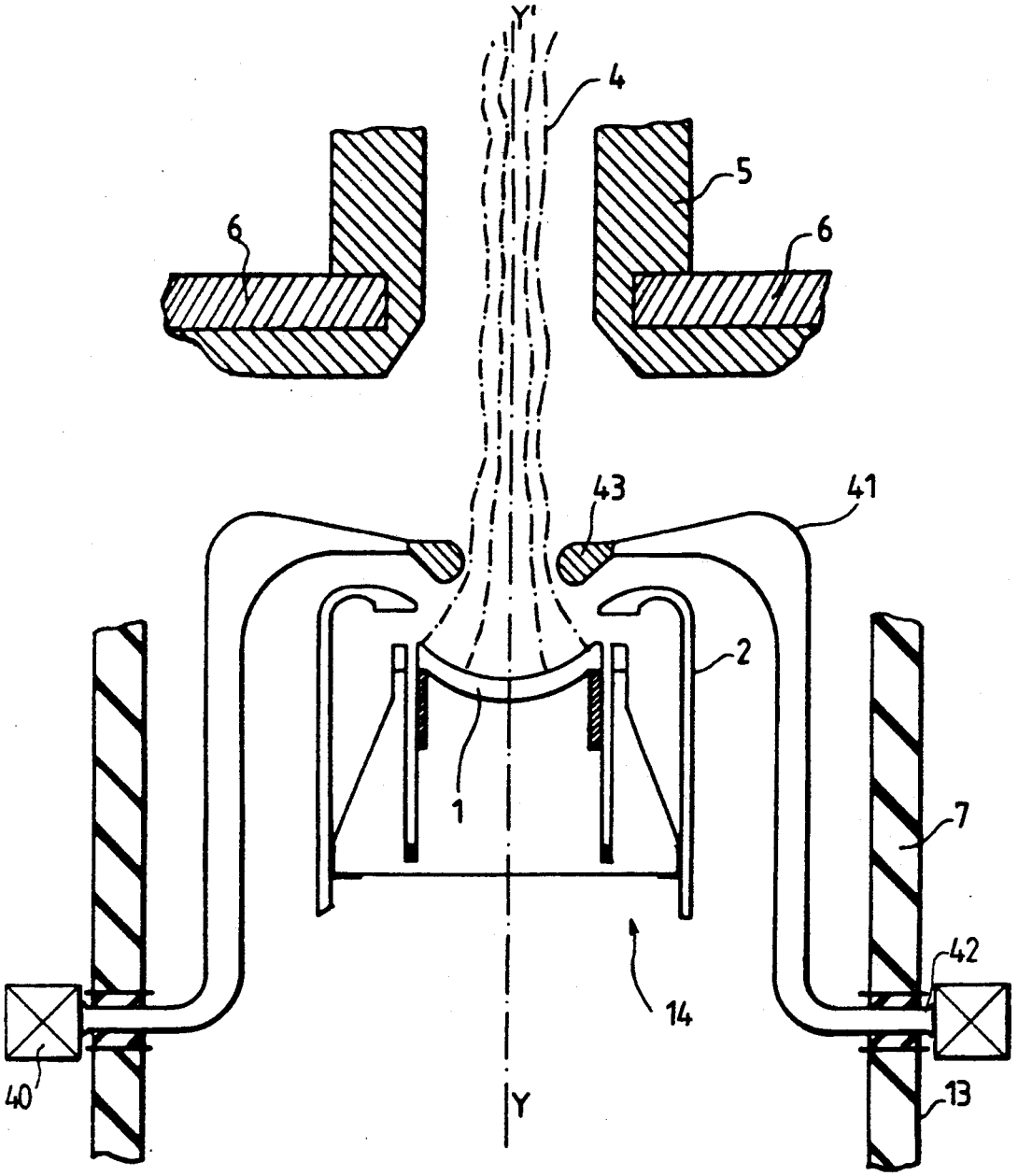
FIG. 4 shows a sectional view of an electron gun including an anode fitted out with an external solenoid designed to adjust the magnetic field in the vicinity of the cathode.

FIG. 4 shows a sectional view of a gun comparable to that of FIG. 1. It is provided with another variant of the device producing the adjustable magnetic field in the vicinity of the cathode.

The device producing the adjustable magnetic field is formed by a solenoid 40 placed so as to be in contact with the anode 41 A first end 42 of the anode 41 is fixedly joined to the spacers 7, 13. It is at this first end 42 that the contact is set up between the anode 41 and the solenoid 40. The solenoid is placed outside the chamber 14.

This device producing the adjustable magnetic field may be used in guns working at lower voltage. In this case, the diameter of the gun is smaller, and it becomes harder to integrate a solenoid inside the anode or the wehnelt cylinder.

The anode 41 will be either partially or wholly made of a magnetic, metallic material to guide the magnetic flux from the solenoid towards a region in the immediate vicinity of the cathode. In the figure, it is partially made of a magnetic metallic material. The second end 43, close to the cathode 1 and surrounding the electron beam, is made of another material, for example molybdenum.

The solenoid is supplied by a supply that is not shown. This supply is referenced with respect to the potential of the anode 41 as in the foregoing case.

Figure 5:
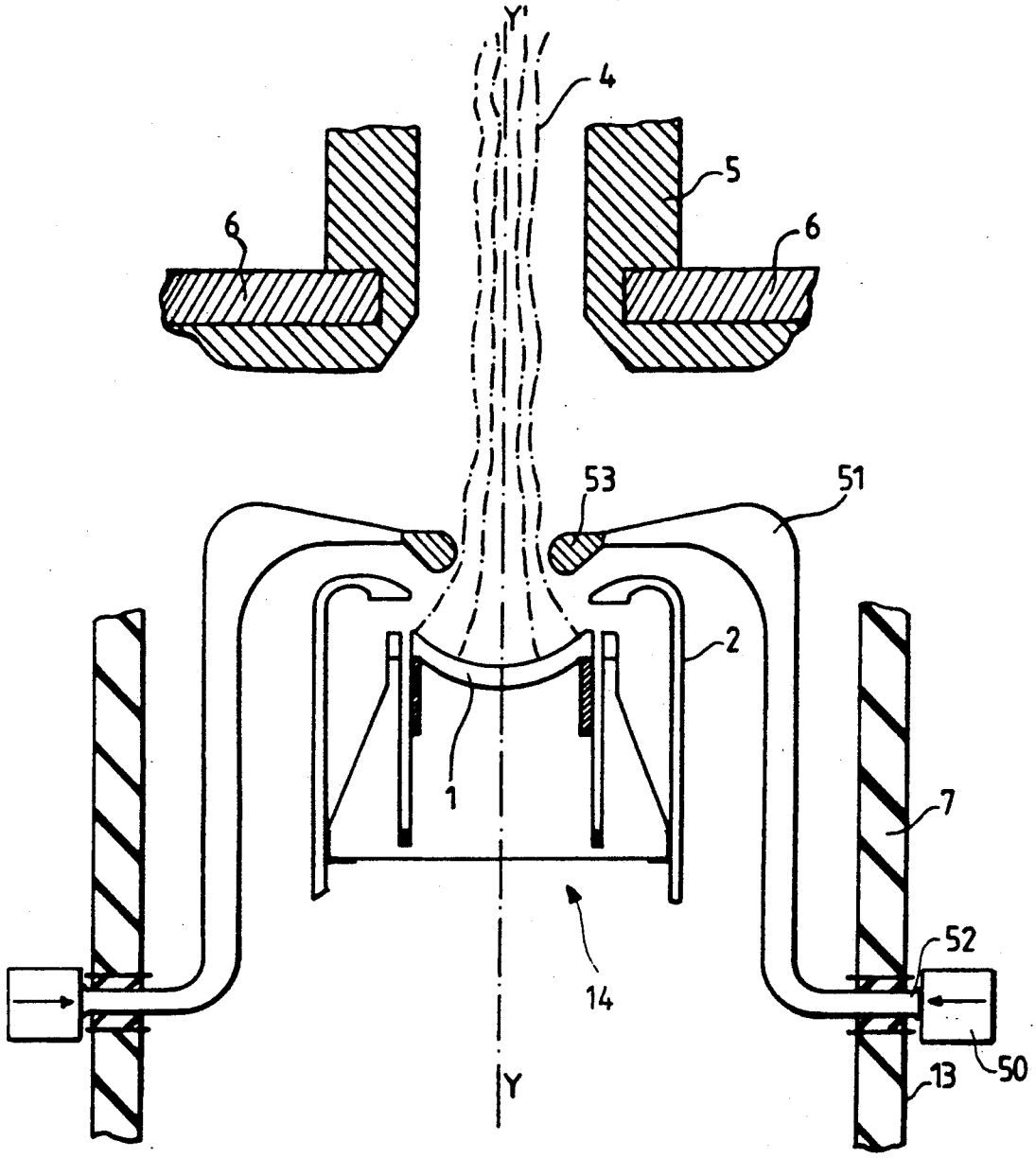
FIG. 5 shows a sectional view of an electron gun including an anode fitted out with a plurality of external magnets designed to adjust the magnetic field in the vicinity of the cathode.

FIG. 5 shows a sectional view of an electron gun, comparable to that of FIG. 4. It is provided with a new variant of the device producing the magnetic field in the vicinity of the cathode.

In this figure, the device producing the magnetic field is constituted by one or more magnets 50, magnetized beforehand.

These magnets are placed in the form of a ring outside the chamber 14 and are in contact with the anode 51. A first end 52 of the anode 51 is fixedly joined to the spacers 7, 13. It is at this first end 52 that the contact is set up between the anode 51 and the magnets 50. The magnets 50 are arranged so that their induction lines are pointed towards the interior of the anode 51. In this case, the anode 51 is wholly or partially made of a magnetic, metallic material. FIG. 5 shows the second end 53 of the anode 51, close to the cathode 1, made of another material, for example molybdenum. The magnets 50 are carried to the same potential as the anode 51. There may be any number of magnets 50. It is possible to make a relatively fine adjustment of the magnetic field in the vicinity of the cathode 1 by modifying the number of magnets 50 placed in the form of a ring around the anode 51 and by modifying their position.

Through the invention, it will even be possible to eliminate the external shielding of the gun when a solenoid or a plurality of magnets is placed around the gun.

The invention is not restricted to the examples described. A great many variants may come into play as regards the shape or the position of the device producing a magnetic field in the vicinity of the cathode, without going beyond the scope of the than the cathode, to be provided with the device producing a magnetic field in the vicinity of the cathode.

What is claimed is:

1. An electron gun connected to an electron tube body comprising: several electrodes including a cup shaped emitting cathode, means including a solenold working together with an electrode, except the cathode, for setting up a controlled magnetic field in the vicinity of the cathode, and means for adjusting the current in the solenold in order to obtain at an entrance of the tube body, a cylindrical electron beam with minimum scalloping, the magnetic flux being quasi nul on the cathode and increasing towards the entrance of the tube body.

2. An electron gun according to claim 1 wherein the solenold is located in a cavity prepared inside the electrode, said cavity being without contact with the interior of the gun and having means for communication with the exterior.

3. An electron gun according to claim 1 or 2, wherein the solenold is connected to an electrical supply, the potential of which being referenced with respect to the potential of the electrode it works through with.

4. An electron gun according to claim 1, wherein the electrode working with the solenoid is made, wholly or partly, of magnetic material.

5. An electron gun according to claim 1, wherein the electrode working with the solenold is an anode of the gun.

6. An electron gun according to claim 1, wherein the electrode working with the solenoid is an wehnelt cylinder of the gun.

7. An electron gun according to claim 1, wherein the solenold is connected in electrical series with a heating filament of the cathode.

8. An electron tube with longitudinal interaction comprising an electron gun according to claim 1.

* * * * *